US006708006B2

(12) United States Patent
Eck

(10) Patent No.: US 6,708,006 B2
(45) Date of Patent: Mar. 16, 2004

(54) IMAGE-FORMING MACHINE HAVING A DEVELOPMENT STATION WITH A DEVELOPER FLOW MONITORING SYSTEM

(75) Inventor: Edward M Eck, Lima, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/059,500

(22) Filed: Jan. 29, 2002

(65) Prior Publication Data

US 2003/0142986 A1 Jul. 31, 2003

(51) Int. Cl.[7] ..... G03G 15/08
(52) U.S. Cl. ..... 399/29

(58) Field of Search ..... 399/27, 29, 30, 399/58, 59, 61, 62, 63, 119, 252, 258

(56) References Cited

U.S. PATENT DOCUMENTS 4,615,606 A * 10/1986 Nishikawa ..... 399/272
4,878,088 A * 10/1989 Nakanishi et al. ..... 399/119
4,955,317 A * 9/1990 Kinoshita et al. ..... 399/62
5,111,247 A * 5/1992 Nichols ..... 399/63
6,167,211 A * 12/2000 Oogi et al. ..... 399/53

* cited by examiner

*Primary Examiner*—Hoan Tran

(57) ABSTRACT

A development station has a developer flow monitoring system for an image-forming machine. The developer flow monitoring system senses the material flow of a developer in the development station.

29 Claims, 6 Drawing Sheets

IMAGE-FORMING MACHINE HAVING A DEVELOPMENT STATION WITH A DEVELOPER FLOW MONITORING SYSTEM

FIELD

This invention generally relates to image-forming machines having a development station for an eletrophotographic process. More particularly, this invention relates to image-forming machines having a sensing device for monitoring the developer flow properties in the development station.

BACKGROUND

Image-forming machines transfer images onto paper or other medium using an electrophotographic process. An image-forming machine typically has a photoconductor, one or more chargers, an exposure machine, a development station, a fuser station, and a cleaning station. The image-forming machine also may have a logic control unit (LCU) or other microprocessor, a graphic user interface, and other components.

The photoconductor is selectively charged and optically exposed to form an electrostatic latent image on the surface. The development station deposits toner onto the photoconductor surface. The toner is charged and thus adheres to the photoconductor surface in areas corresponding to the electrostatic latent image. The toner image is transferred onto a sheet of paper or other medium. In the fuser station, the sheet is heated causing the toner to fix or adhere to the paper or other medium. The photoconductor is refreshed, cleaned to remove residual toner and charge, and then is ready to make another image. The sheet exits the image-forming equipment.

At the development station, toner is attracted to the photoconductor under the influence of an electric field. The development station stores and mixes a developer, which may be mono-component or bi-component. A mono-component developer comprises toner. A bi-component developer comprises a mixture of toner and a carrier. Toner is the marking material in an image-forming machine and usually comprises a polymer, a pigment, and a charging agent. Carrier is a transport media and comprises magnetic particles typically made of iron or an iron-based material. The mixing of the developer tribo-electrically charges the toner in a mono-component system and the toner and carrier in a bi-component system. The toner is transported to a development region adjacent to the photoconductor. The electric field in the development region transfers the toner from the development station to the photoconductor. Portions of the surface having the electrostatic latent image attract the toner. The toner turns the electrostatic latent image into a visible image. Portions on the surface not having the electrostatic latent image do not attract the toner.

Many image-forming machines have a toner monitor in the development station. The toner monitor generally is a magnetic sensing device that provides a output voltage responsive to the toner concentration—the ratio of the toner to carrier in the developer mix. The toner monitor also may be an electrical or optical sensing device. The logic control unit (LCU) in the image-forming machine uses the output voltage to determine when to replenish toner in the development station.

Most image-forming machine do not measure a change in the flow properties of the developer in the development station. Setup and operation of a development station typically assumes that material properties will remain essentially constant. Typically, an image-forming machine has little or no way to identify a change in material flow properties other than a visual difference. The material flow properties of the developer may change due to one or a combination of factors such as the material characteristics of the developer, the variability of properties in the developer, and the environmental conditions during the storage and use of the developer. Environmental conditions include temperature, humidity, pressure, impurities, and the like. Many image-forming machines have a warming device in the development station to reduce the effect of humidity and temperature variation on the developer.

In addition, an image-forming machine usually has little or no way to identify when hardware changes have modified the material flow of the developer. These hardware changes may occur from servicing the image-forming machine, performing maintenance on the image-forming machine, and operating the image-forming machine. During service and maintenance, the hardware in the image-forming machine may be adjusted or repositioned. During operation, the flow properties may vary due to the variability in operation of the image-forming machine such as when the development station starts and ends mixing of the developer. Other hardware changes may affect the flow properties of the developer.

Improper material flow in a development station may result in poor mixing and poor delivery of the toner to the photoconductor. With improper material flow, developer may accumulate on the inside of the development station. New toner may flow pass the accumulated developer without mixing properly with the developer. This improperly flowing toner may have a poor tribo-electric change and may have an uneven concentration when transported to the photoconductor. The improper material flow may cause image-quality defects such as fogging and fading. Fogging occurs when too much toner attaches to the image. Fading occurs when too little toner attaches to the image. The fogging and fading may appear on the same image.

The improper material flow may result in improper adjustments to the toner concentration. Some image-forming machines increase the aim toner concentration as the imaging cycles through the development station increase. The toner concentration also may be increased in response to a fading defect. However, the fading maybe the result of an improper tribo-electric change and not due to a low concentration of toner. Other image-quality defects and operational difficulties may result from improper material flow.

SUMMARY

This invention provides a development station with a developer flow monitoring system for an image-forming machine. The developer flow monitoring system senses the material flow of a developer in the development station.

In one aspect, an image-forming machine one or more chargers, an exposure machine, and a development station operatively connected to a photoconductor. The chargers electrostatically charge the photoconductor. The exposure machine forms an electrostatic image on the photoconductor. The development station applies toner on the photoconductor. The development station has a material flow sensing device mounted on a developer sump. The material flow sensing device generates a material flow signal in response to a material flow of a developer in the developer sump.

In another aspect, a development station for an image-forming machine has a ribbon blender, a bucket assembly, and a toning roller operatively mounted in a developer sump. The development station also has a material flow sensing device mounted on the developer sump. The material flow sensing device generates a material flow signal in response to a material flow of a developer in the developer sump.

In a method for monitoring material flow in a development station of an image-forming machine, a material flow signal is generated in response to a material flow of a developer in the development station. The material flow signal is compared to a reference flow signal.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
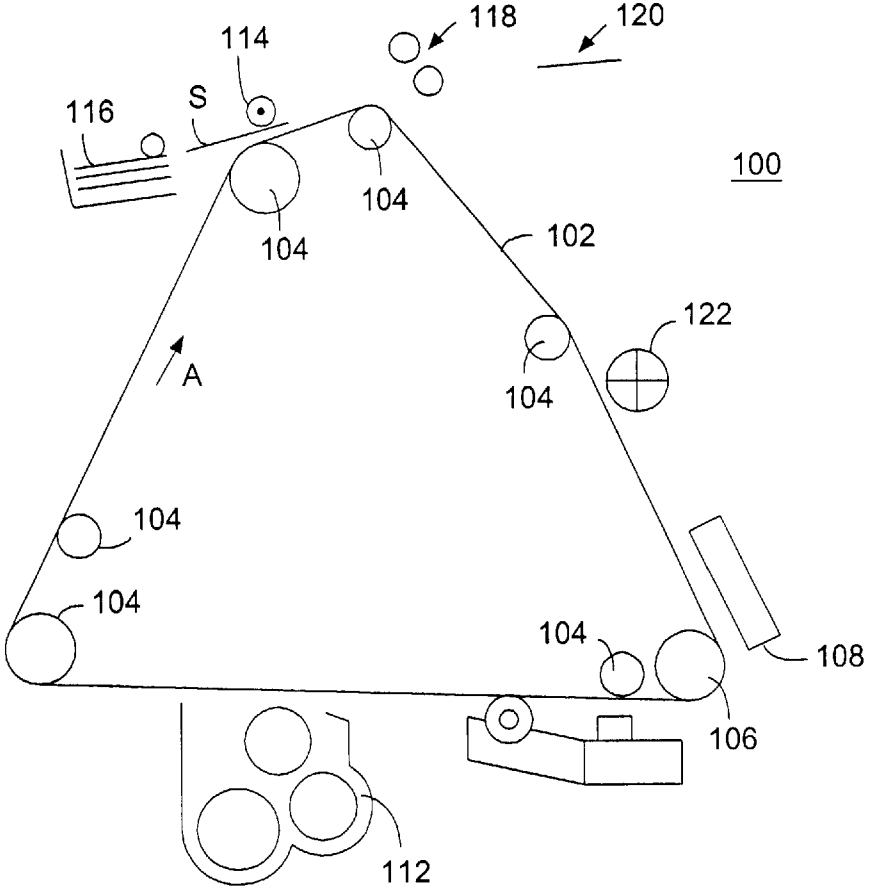
FIG. 1 represents a schematic diagram of an image-forming machine having a development station with a developer flow monitoring system according to an embodiment.

FIG. 1 represents a schematic diagram of an image-forming machine 100 having a development station 112 with a developer flow monitoring system according to an embodiment. The image-forming machine 100 may be an electrophotographic device such as one of the Digimaster® digital printers manufactured by Heidelberg Digital L.L.C. located in Rochester, N.Y. The image-forming machine 100 may be another eletrophotographic machine, a photocopy machine, a printer device, or the like. The image-forming machine 100 also has a photoconductor 102, a primary charger 108, an exposure machine 110, a transfer charger 114, a fuser station 118, a cleaning station 122, and related equipment such as support rollers 104, a motor driven roller 106, a feeder 116, and a discharge tray 120. The feeder 116 provides sheets of paper or other medium. The image-forming machine 100 also may have a logic and control unit (not shown), a user interface (not shown), an inverter (not shown), a housing (not shown), and the like. The image-forming machine 100 may have other equipment such as an inserter (not shown) and a finisher (not shown). While particular configurations are shown, other configurations and arrangements may be used including those with additional and fewer components.

In one aspect, the photoconductor 102 is operatively mounted on the support rollers 104 and the motor driven roller 106, which moves the photoconductor 102 in the direction indicated by arrow A. The primary charger 108, the exposure machine 110, the development station 112, the transfer charger 114, the fuser station 118, and the cleaning station 122 are operatively connected adjacent to the photoconductor 102. Operatively connected includes electrical, mechanical, and other connections as well as the spatial positioning with the photoconductor 102 for an electrophotographic process. The feeder 116 is operatively connected to provide a sheet S of paper or other medium to the transfer charger 114. Multiple sheets may be processed in this manner or the like. The photoconductor 102 has a belt and roller-mounted configuration and may have a drum or other suitable configuration. The housing (not shown) supports and protects various components of the image-forming system 100, which may be integrated with or part of the housing.

Figure 2:
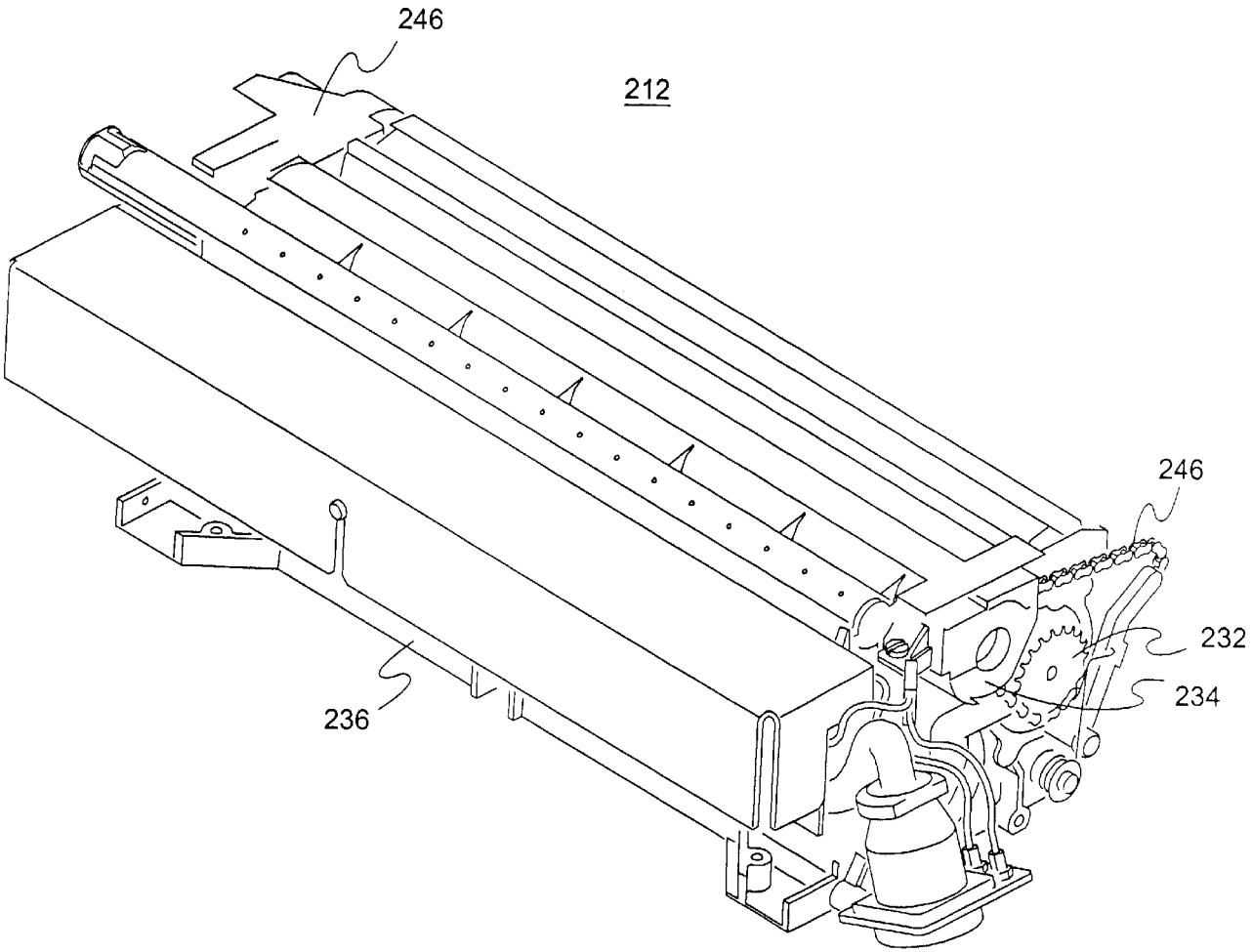
FIG. 2 represents an external perspective view of a development station with a developer flow monitoring system according to one embodiment.
Figure 3:
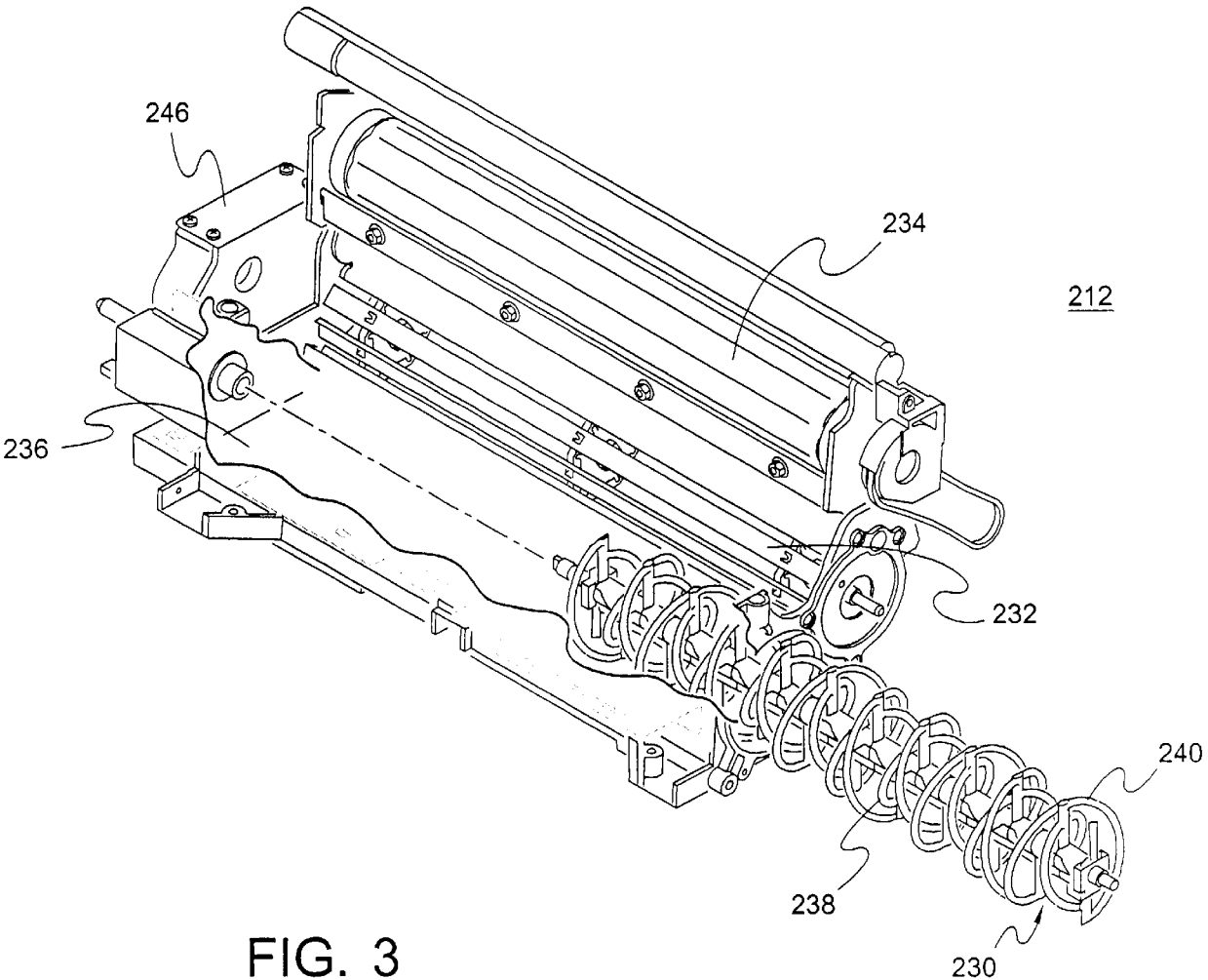
FIG. 3 represents a partially unassembled view of the development station shown in FIG. 2.
Figure 4:
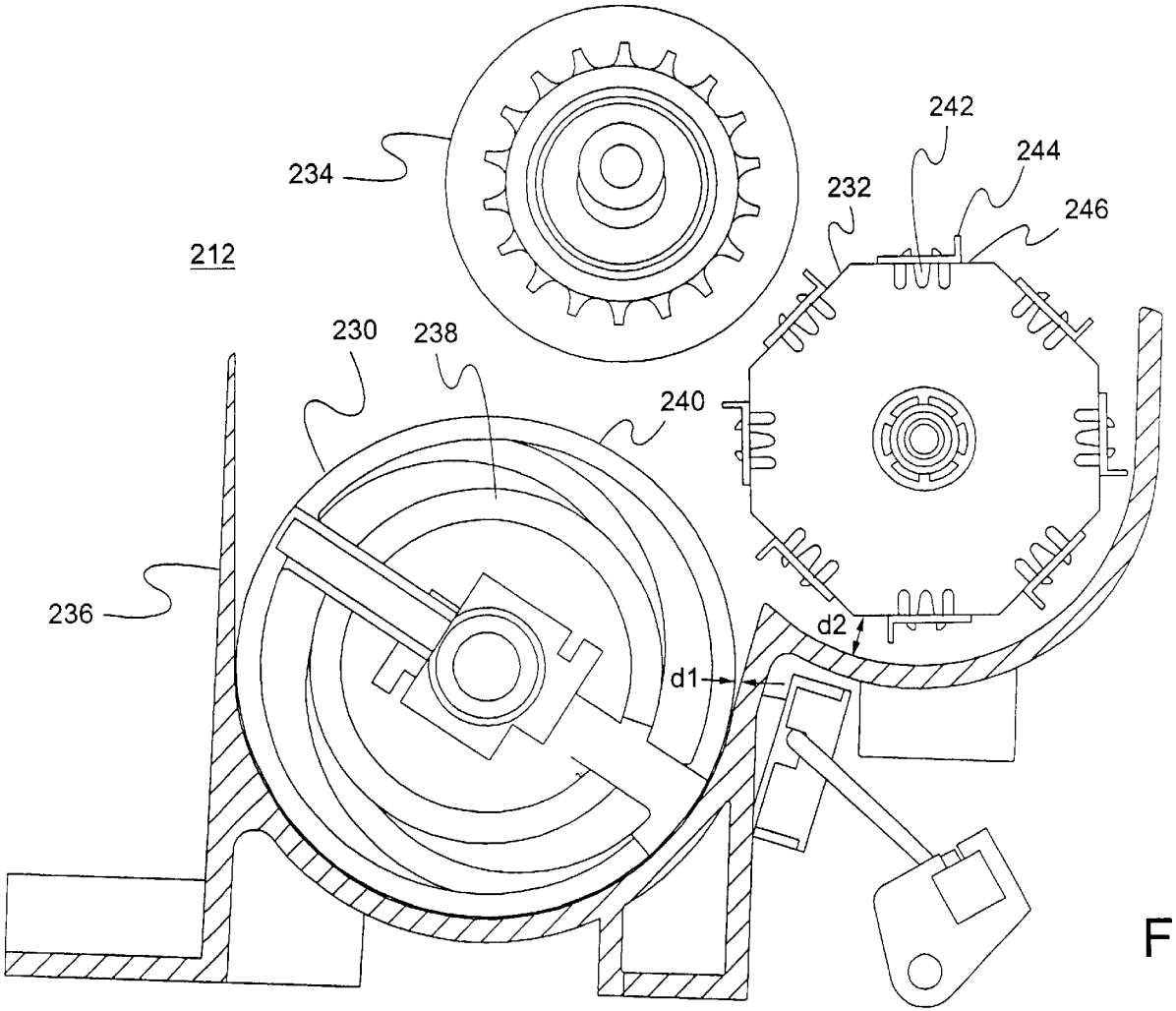
FIG. 4 represents an internal end view of the development station show in FIG. 2.
Figure 5:
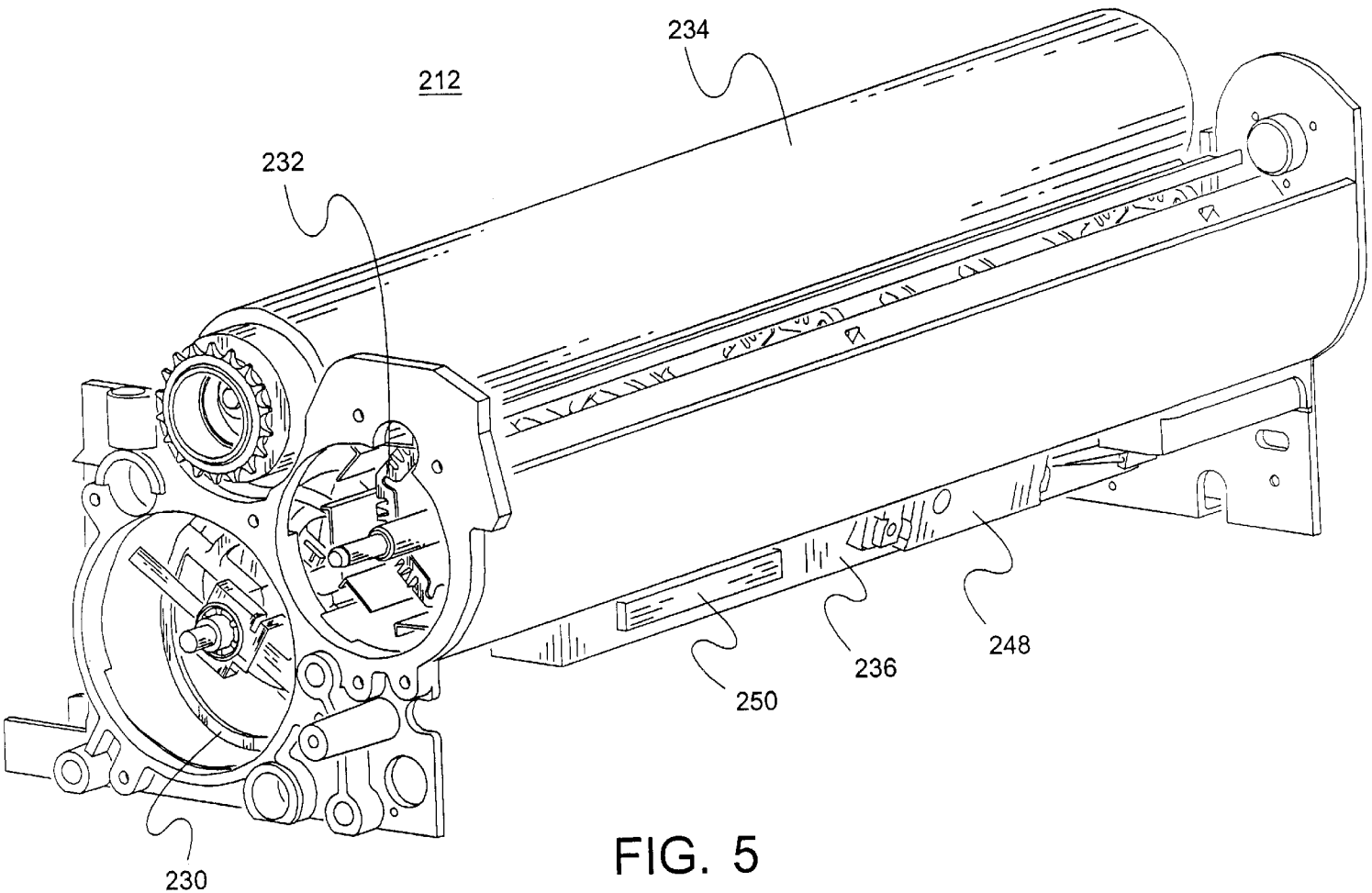
FIG. 5 represents an internal perspective view of the development station shown in FIG. 2.

FIGS. 2–5 represent views of a development station 212 with a developer flow monitoring system according to one embodiment. FIG. 2 represents an external perspective view of the development station 212. FIG. 3 represents a partially unassembled view of the development station 212. FIG. 4 represents an internal end view of the development station 212. FIG. 5 represents an internal perspective view of the development station 212.

The development station 212 has a ribbon blender 230, a bucket assembly 232, and a toning roller 234 operatively mounted and positioned longitudinally to each other in a developer sump or housing 236. Operatively mounted includes the electrical and mechanical connections for each of the ribbon blender 230, the bucket assembly 232, and the toning roller 234 to rotate in the development station 212 and to transport toner as described below. The respective axes of the ribbon blender 230, the bucket assembly 232, and the toning roller 234 form a triangular arrangement. The ribbon blender 230 has a distance, d1, from the developer sump 236. The bucket assembly has a distance, d2, from the developer sump 236. The distances d1 and d2 may be measured from any portion on the developer sump 236. In one aspect, the distance d1 is measured from the location of the material flow sensing device as described below. Each of the distances d1 and d2 also may be adjusted during or after assembly of the development station 212 or the image-forming machine. Each of the distances d1 and d2 also may be adjusted manually or may be adjusted automatically by the LCU or another microprocessor.

The development station 212 uses a bi-component developer having a toner with a carrier. The ribbon blender 230 transports developer to the bucket assembly 232, which transports the developer to the toner roller 234. The bucket assembly 232 also returns the carrier and unused developer from the toner roller 234 to the developer sump 236 for mixing with additional toner. The toner roller 234 supplies toner to a development region where toner adheres to an electrostatic image on a photoconductor. The ribbon blender 230, bucket assembly 232, and toner roller 234 rotate to transport toner to the development region. In one aspect, the ribbon blender 230 and bucket assembly 232 rotate counter-clockwise. In this aspect, the toner roller 234 rotates in the same direction and at the same speed as the photoconductor. The development station 212 may have other configurations and arrangements including those with fewer and additional components and may use a mono-component developer.

The ribbon blender 230 mixes the developer in the developer sump 236. The ribbon blender 230 has a helical configuration with sets of inner blades 238 and outer blades 240. The inner blades 238 move the developer axially toward the ends of the ribbon blender 230. The outer blades 240 move the developer axially toward the middle of the ribbon blender 238. The mixing action of the inner and outer blades 238 and 240 produces and maintains an essentially uniform tribo-electric charge on the developer. The counter-clockwise rotation of the ribbon blender 230 moves the developer to the bucket assembly 232. The ribbon blender 230 may have other configurations including those with fewer or additional components.

The bucket assembly 232 forms one or more bucket openings 242, each having a leveling blade 244 connected to a trailing edge 246. The bucket assembly 232 receives and continues mixing developer from the ribbon blender 230. The leveling blades 244 scrape at an essentially even level. The bucket openings 242 rotate counter-clockwise, carrying and delivering the developer to the toning roller 234. The bucket assembly 232 may have other configurations including those with fewer or additional components.

The toning roller 234 has an eccentrically and internally mounted magnetic roller (not shown), which attracts the developer from the bucket assembly 232. The toning roller 234 transports the developer to a development region, where the toner "attracted" to the photoconductor. The toning roller 234 returns the carrier and unused toner to the bucket assembly 232 for return to the ribbon blender 230. The toning roller 234 may have other configurations including those with fewer and additional components.

One or more drive mechanisms 246 are operatively connected to the ends of the ribbon blender 230, the bucket assembly 232, and the toning roller 234. The drive mechanisms 246 may be gear-driven, chain-driven, or combination thereof, or use another drive device. The drive mechanisms 246 rotate the ribbon blender 230, the bucket assembly 232, and the toning roller 234 at a speed and direction to transport the developer to the development region. In one aspect, the drive mechanisms 246 adjust the distances d1 and d2 of the ribbon blender 230 and the bucket assembly 232, respectively. The drive mechanisms 246 adjust the distances d1 and d2 in response to a first distance signal and a second distance signal, respectively, from the LCU or another microprocessor. In another aspect, the drive mechanisms 246 adjust one of the distances d1 and d2 in response to a distance signal. One or both of the distances d1 and d2 may be adjusted by other mechanisms and by other arrangements.

The development station 212 has a toner concentration monitor 248 positioned through the wall of the developer sump 236 adjacent to the ribbon blender 230. The toner concentration monitor 248 determines the ratio of toner and carrier in the developer. The toner concentration monitor 248 may be a magnetic, electrical, or optical sensing device. The toner concentration monitor 248 generates measured concentration voltage in response to the concentration of the toner in the developer. The LCU compares the measured concentration voltage to an aim concentration voltage to determine whether additional toner should be added to the developer.

The development station 212 has a material flow sensing device 250 positioned through the wall of the developer sump 236. The material flow sensing device may be positioned adjacent to the ribbon blender 230 at distance d1, adjacent to the bucket assembly at distance d2, or elsewhere on the developer sump 236. The development station 212 may have multiple material flow sensing devices (not shown). The material flow sensing device 250 is a magnetic responsive device. The material flow sensing device 250 generates a material flow signal in response to the magnetic density of the developer. The magnetic density increases with an increase in material flow. The magnetic density decreases with a decrease in material flow. The material flow sensing device 250 may be an electrical, optional, or other flow responsive device.

In one aspect, the material flow sensing device 250 and the toner concentration monitor 248 are separate components. In another aspect, the material flow sensing device 250 and the toner concentration monitor 248 comprise an integrated sensing system having separate sensing components. In a further aspect, the material flow sensing device 250 and toner concentration monitor 248 comprise an integrated sensing system having one sensing component.

In operation, the material flow sensing device 250 provides the material flow signal to the logic control unit (LCU). The material flow signal is within the range of about 1 VDC (volts, direct current) through about 3 VDC for a developer having about 10% toner and about 90% carrier. The developer may have other concentrations, and material flow signal may have other voltage ranges. Other developers may be used.

The LCU compares the material flow signal to a reference flow signal. The reference flow signal represents the set or desired material flow of the developer. The reference flow signal may be a value stored in the memory of the LCU. The reference flow signal also may be determined by analyzing the developer in use. The material flow of a developer having a known material composition, structure, and other factors is measured and provides the reference flow signal when the developer is first used. When the developer is changed, the reference flow signal is updated to correspond with the new developer. In one aspect, the reference flow signal is about 2 VDC. Other reference voltages may be used. If the material flow signal is greater than a high reference, the LCU determines that the material flow of the developer is fast. If the material flow signal is less than a low reference, the LCU determines that the material flow is slow. In one aspect, the high reference is about 10 percent greater than the reference flow signal and the low reference is about 10 percent less than the reference flow signal. In another aspect, the high reference is about 2.3 VDC and the low reference about 1.9 VDC. The high and low references may be other voltages.

In response to a slow or fast material flow, the LCU may alert a user through a message on an operation interface through an alarm such as a light or sound, or through another alert device. The LCU additionally or alternatively may send a distance signal to the ribbon blender 230 or the bucket assembly 232 to adjust one or both of the distances d1 and d2. If the material flow is fast, the LCU may increase one or both of the distances d1 and d2. If the material flow is slow, the LCU may decrease one or both of the distances d1 and d2.

The LCU may move the ribbon blender 230 and the bucket assembly 232 incrementally or continuously. In one aspect, the LCU moves one or both of the ribbon blender 230 and the bucket assembly 232 until the material flow signal is within the high and low references. In another aspect, the LCU moves one or both of the ribbon blender 230 and the bucket assembly until the material flow signal is essentially equal to the reference flow signal.

Figure 6:
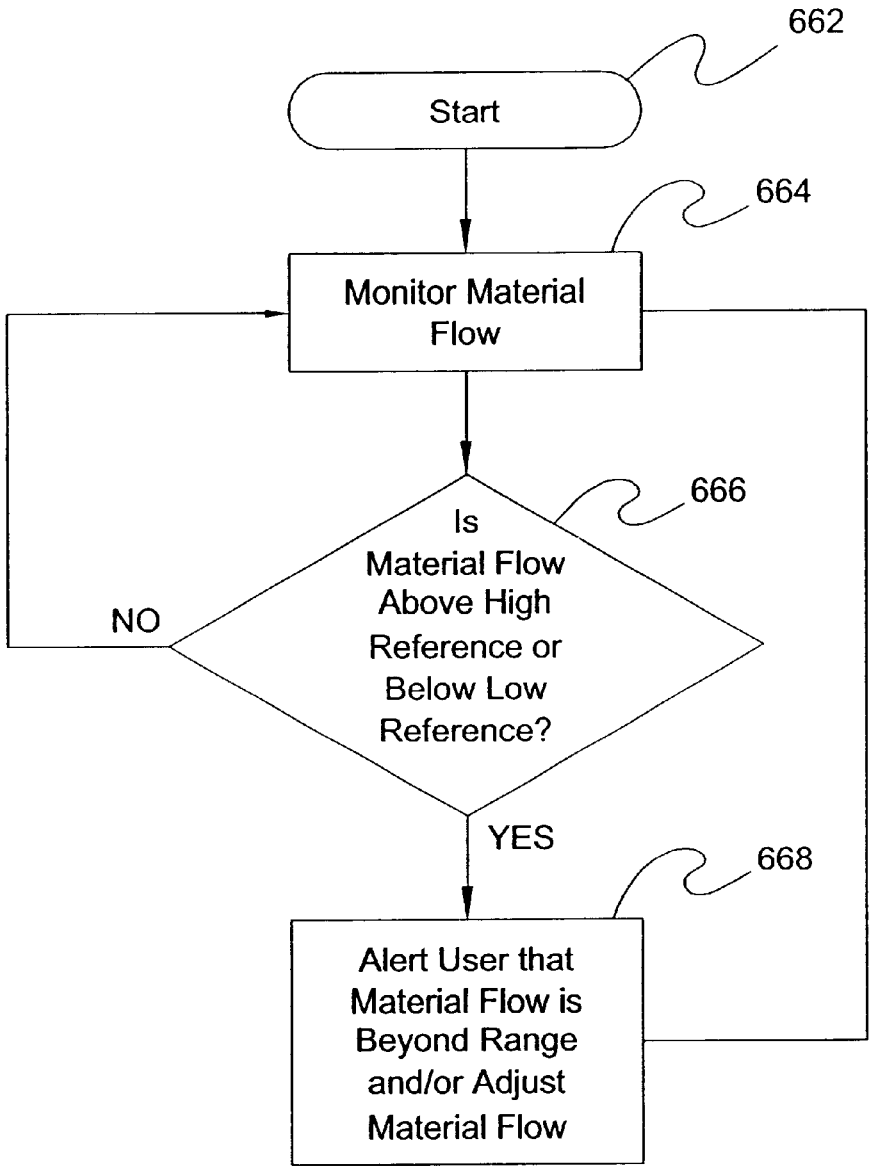
FIG. 6 is a flowchart of a method for monitoring the material flow in a development status of an image-forming machine according to one embodiment.

FIG. 6 is a flowchart of a method for monitoring material flow in a development station of an image-forming machine according to one embodiment. At start 662, the image-forming machine and development station have been activated and are preparing to process or are processing an imaging job. The image-forming machine monitors 664 the material flow in the development station as previously discussed. The image-forming machine determines 666 whether the material flow is equal to or above a high reference or is equal to or below a low reference. If the image-forming machine is not above the high reference or below a low reference 666, the image-forming continues to monitor 664 the material flow. If the image-forming machine is equal to or above the high references or is equal to or below the low reference 666, the image-forming alerts 668 the user that the material flow is beyond an acceptable range and/or adjusts 668 the material flow as previously discussed.

Various embodiments of the invention have been described and illustrated. However, the description and illustrations are by way of example only. Other embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An image-forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station to apply toner to the photoconductor, the development station comprising a material flow sensing device mounted on a developer sump, the material flow sensing device to generate a material flow signal in response to a material flow of a developer in the developer sump.

2. The image-forming machine according to claim 1, where the development station comprises a ribbon blender, a bucket assembly, and a toning roller operatively mounted on the developer sump, where the ribbon blender has a first distance from the developer sump, where the bucket assembly has a second distance from the developer sump, and where at least one of the first and second distances is adjusted in response to the material flow signal.

3. The image-forming machine according to claim 2, further comprising at least one drive mechanism connected to at least one of the ribbon blender and the bucket assembly, the at least one drive mechanism to adjust at least one of the first and second distances.

4. The image-forming machine according to claim 2, where at least one of the first and second distances is adjusted when the material flow signal is greater than a high reference.

5. The image-forming machine according to claim 4, where the high reference is about 10 percent greater then a reference flow signal.

6. The image-forming machine according to claim 5, where the reference flow signal is about 2 VDC.

7. The image-forming machine according to claim 2, where at least one of the first and second distances is adjusted when the material flow signal is less than a low reference.

8. The image-forming machine according to claim 7, where the low reference is about 10 percent less than a reference flow signal.

9. The image-forming machine according to claim 8, where the reference flow signal is about 2 VDC.

10. The image-forming machine according to claim 1, further comprising a toner concentration monitor mounted on the developer sump, the toner concentration monitor to generate a measured concentration voltage in response to a concentration of a toner in the developer.

11. The image-forming machine according to claim 10, where the material flow sensing device and the toner concentration monitor comprise an integrated sensing system.

12. The image-forming machine according to claim 1, where the material flow sensing device comprises a magnetic responsive device.

13. A development station for an image-forming machine comprising:

a ribbon blender, a bucket assembly, and a toning roller operatively mounted in a developer sump; and a material flow sensing device mounted on the developer sump, the material flow sensing device to generate a material flow signal in response to a material flow of a developer in the developer sump.

14. The development station according to claim 13, where the ribbon blender is operatively mounted a first distance from the developer sump;

where the bucket assembly is operatively mounted a second distance from the developer sump, and where at least one of the first and second distances is adjusted in response to the material flow signal.

15. The development station according to claim 14, where at least one of the first and second distances is adjusted when the material flow signal not equal to a reference flow signal.

16. The development station according to claim 14, where at least one of the first and second distances is adjusted when the material flow signal is one of greater than a high reference and less than a low reference.

17. The development station according to claim 16, where the high reference is about 10 percent greater than a reference flow signal, and where the low reference is about 10 percent less than the reference flow signal.

18. The development station according to claim 17, where the reference flow signal is about 2 VDC.

19. The development station according to claim 14, further comprising at least one drive mechanism connected to at least one of the ribbon blender and the bucket assembly, the at least one drive mechanism to adjust at least one of the first and second distances.

20. The development station according to claim 13, further comprising a toner concentration monitor mounted on the developer sump, the toner concentration monitor to generate a measured concentration voltage in response to a concentration of a toner in the developer.

21. The development station according to claim 20, where the material flow sensing device and the toner concentration monitor comprise an integrated sensing system.

22. The development station according to claim 13, where the material flow sensing device comprises a magnetic responsive device.

23. A method for monitoring material flow in a development station of an image-forming machine, comprising:

generating a material flow signal in response to a material flow of a developer in the development station; and comparing the material flow signal to a reference flow signal.

24. The method according to claim 23 further comprising comparing the material flow signal to at least one of a high reference and a low reference.

25. The method according to claim 24, where the high reference is about 10 percent greater than the reference flow signal; and where the low reference is about 10 percent less than the reference flow signal.

26. The method according to claim 23, further comprising alerting a user in response to the material flow signal.

27. The method according to claim 23, further comprising adjusting a distance between a ribbon blender and a developer sump in the development station in response to the material flow signal.

28. The method according to claim 23, further comprising adjusting a distance between a bucket assembly and a developer sump in the development station in response to the material flow signal.

29. The method according to claim 23, further comprising generating a measured concentration voltage in response to a concentration of a toner in the developer.

* * * * *